US008581687B2

(12) United States Patent
Belman

(10) Patent No.: US 8,581,687 B2
(45) Date of Patent: Nov. 12, 2013

(54) FOUR-TERMINAL RESISTOR WITH FOUR RESISTORS AND ADJUSTABLE TEMPERATURE COEFFICIENT OF RESISTANCE

(75) Inventor: Michael Belman, Beer Sheva (IL)

(73) Assignee: Vishay Dale Electronics, Inc., Columbus, NE (US)

( * ) Notice: Subject to any disclaimer, the term of this patent is extended or adjusted under 35 U.S.C. 154(b) by 3 days.

(21) Appl. No.: 13/127,838

(22) PCT Filed: Aug. 11, 2009

(86) PCT No.: PCT/IL2009/000783

§ 371 (c)(1),
(2), (4) Date: May 5, 2011

(87) PCT Pub. No.: WO2010/052697

PCT Pub. Date: May 14, 2010

(65) Prior Publication Data

US 2011/0260826 A1 Oct. 27, 2011

Related U.S. Application Data

(60) Provisional application No. 61/111,735, filed on Nov. 6, 2008.

(51) Int. Cl.
*H01C 1/14* (2006.01)

(52) U.S. Cl.
USPC ..... 338/325; 338/332; 338/293; 29/621.1

(58) Field of Classification Search
USPC ..... 338/325
See application file for complete search history.

(56) References Cited

U.S. PATENT DOCUMENTS

| | | | |
|---|---|---|---|
| 3,259,843 | A | 7/1966 | Hurst |
| 3,536,997 | A | 10/1970 | Holt |
| 4,418,474 | A | 12/1983 | Barnett |

(Continued)

FOREIGN PATENT DOCUMENTS

| | | |
|---|---|---|
| EP | 1 087 219 | 3/2001 |
| GB | 696837 | 9/1953 |

(Continued)

OTHER PUBLICATIONS

Japanese Office Action issued Jun. 18, 2013 in corresponding Japanese Application No. 2011-535204 and English Translation.

*Primary Examiner* — Kyung Lee
(74) *Attorney, Agent, or Firm* — Volpe and Koenig, P.C.

(57) ABSTRACT

Thermally stable four-terminal resistor (current sensor) is characterized by having the capacity to adjust both resistance and temperature coefficient of resistance (TCR), during manufacturing process. The four-terminal resistor includes 3 or 4 elementary resistors R1-R3 forming a closed loop. Resistor R1 is the principal low-ohmic value resistor. The terminals of resistor R1 serve as "Force" terminals of the four-terminal resistor. Resistors R2, R3 form a voltage divider intended to minimize the TCR of the four-terminal resistor and connected in parallel to resistor R1. The terminals of resistor R3 serve as "Sense" terminals of the four-terminal resistor. Resistor R2 may be split into two resistors: R2*a*, R2*b* to simplify the implementation of four-terminal resistor. Elementary resistors R1, R2 must have the same sign of TCR. Target resistance and TCR minimization in four-terminal resistor are reached by adjustment of resistance of the elementary resistors.

12 Claims, 4 Drawing Sheets

(56) References Cited

U.S. PATENT DOCUMENTS

| | | | | |
|---|---|---|---|---|
| 4,620,365 | A * | 11/1986 | Burger et al. | 29/621.1 |
| 4,906,968 | A * | 3/1990 | Gershenfeld et al. | 338/25 |
| 5,287,083 | A * | 2/1994 | Person et al. | 338/332 |
| 5,867,018 | A | 2/1999 | White et al. | |
| 6,150,917 | A * | 11/2000 | Meyer et al. | 338/4 |
| 6,658,948 | B2 * | 12/2003 | Yoshihara et al. | 73/862.628 |
| 6,801,118 | B1 * | 10/2004 | Shindo et al. | 338/307 |
| 7,843,309 | B2 * | 11/2010 | Zandman et al. | 338/195 |

FOREIGN PATENT DOCUMENTS

| | | | |
|---|---|---|---|
| JP | 2005164469 | A | 6/2005 |
| WO | 2002/033424 | A2 | 4/2002 |
| WO | 2007/107014 | | 9/2007 |

* cited by examiner

FOUR-TERMINAL RESISTOR WITH FOUR RESISTORS AND ADJUSTABLE TEMPERATURE COEFFICIENT OF RESISTANCE

RELATED APPLICATION

This application is a U.S. National Stage application based on International Patent Application No. PCT/IL2009/000783, filed Aug. 11, 2009, which claims the benefit of U.S. Provisional Patent Application No. 61/111,735, filed on Nov. 6, 2008, the entire contents of all of which are hereby incorporated by reference as if fully set forth herein.

FIELD OF THE INVENTION

The present invention relates to four-terminal current sensing resistors and more particularly to precision four-terminal resistors with capacity to adjust temperature coefficient of resistance (TCR) during manufacturing process.

BACKGROUND AND PRIOR ART

A variety of common electronic circuits such as power supplies, rechargeable battery controllers and chargers, electric motor drivers, LED drivers, etc., usually contain one or more low-ohmic resistors for current sensing.

Overwhelming majority of commonly used resistors is based on a two-terminal design. Reference is now made to FIG. 1 (prior art), which illustrates by way of example, two-terminal resistor 10. Current I, that is monitored and has to be measured, is forced across resistor terminals 12 and resistive element 14. Voltage V, measured by voltmeter 90, is directly proportional to current I and is sensed across terminals 12.

Terminals 12 and resistive element 14 are electrically connected in series and form compound resistor 10 having resistance R and TCR $\alpha$. Parameters R and $\alpha$ are expressed as functions of resistance $R_e$ and TCR $\alpha_e$ of resistive element 14, and resistance $R_t$ and TCR $\alpha_t$ of terminals 12. Parameters R and $\alpha$ are then computed as follows:

$$R = R_e + R_t; \tag{1}$$

$$\alpha = \frac{\alpha_e R_e + \alpha_t R_t}{R_e + R_t}, \tag{2}$$

Commonly, resistance $R_e$ of resistive element 14 is several orders of magnitude higher than resistance $R_t$ of terminals 12. It follows from equations (1) and (2) that in such a case, resistance R and TCR $\alpha$ of resistor 10 are pre-determined by resistance $R_e$ and TCR $\alpha_e$ of resistive element 14, respectively: $R \approx R_e$; $\alpha \approx \alpha_e$.

In a low-ohmic film chip resistor, the nominal resistance value may have the same order of magnitude as the resistance of the terminals. Resistance of the film terminals may reach 2 milliohms (1 milliohm per each terminal). The TCR of the materials that form a film terminal (for example copper, silver, nickel, tin) is about $+4 \cdot 10^3$ ppm/K.

The share of terminal resistance $R_t$, in total resistance R, can be calculated as in the following example:

given a film resistor with a resistive element that is characterized by 10 milliohm resistance and 30 ppm/K TCR;

if the total resistance of the terminals is 2 milliohms (typical for film resistor), the share of terminal resistance $R_t$, in total resistance R (per equation (1)) is:

$$\frac{2}{(10+2)} * 100\% \approx 16.7\%.$$

This number characterizes the maximum value of the resistance R uncertainty. The resistance R uncertainty becomes apparent, for example, when a resistor is tested while the position of contact probes on terminals varies. The TCR of the total resistor calculated per (2) is as high as 692 ppm/K. That is why the manufacturing of two-terminal film resistors with a tolerance better than 5% and a TCR better than 600 ppm/K is impossible for 10 milliohm nominal resistance value and below.

One way to significantly reduce the influence of the resistance and TCR of terminals on resistance and TCR of low-ohmic resistor is by using a design based on a four-terminal measurement technique, called Kelvin sensing. Reference is now made to FIG. 2 (prior art), which illustrates by way of example, four-terminal resistor 15.

The essence of four-terminal resistor 15 is in using two separate pairs of terminals:

(a) current carrying ("Force") terminals 12; and (b) voltage measurement ("Sense") terminals 16, which are connected directly to the resistive element 14.

The resistance of four-terminal resistor 15 (ratio of "Sense" voltage to current I forced across "Force" terminals 12) is substantially independent of testing and mounting conditions.

The TCR of conventional four-terminal resistors, for example, the thick-film four-terminal current sensing resistor provided by European patent EP 1,473,741, given to Carl Berlin et al, are commonly no better than the TCR of the utilized resistive element material. Further improvement of the thermal stability of resistors is associated with adjustment of the TCR of the resistive element, in the manufacturing process of the resistors. The following are prior art methods to control (adjust) the TCR of a resistor during the manufacturing process:

a) Compensating for intrinsic TCR of the resistive element material in resistive elements made from metal foil. Mismatch of temperature coefficients of expansion (TCE) that characterize foil and the ceramic substrate that the foil is glued to, causes stress and strain in the foil, which are transformed into electrical resistance change (piezoresistive effect).

The compensation method used in precision foil resistors, as described for example in U.S. Pat. No. 3,405,381, given to Felix Zandman et al., brings the resistance change down to sub-ppm/K levels. The method relies on proper selection (preparation) of raw materials and not on TCR adjustment in the resistor assembly process.

b) Manufacturing the resistive element using a special material that when treated by heat changes the physical properties. For example, in thin-film technology, it is possible to precisely adjust by heat treatment the TCR of thin resistive films down to several ppm/K. Unfortunately, for economical reasons, minimal resistance of thin-film resistors cannot be extended far below 1 Ohm, which is common for current sense resistors.

c) Manufacturing the resistive element using special manufacturing processes and materials that make it possible to change the physical properties of the resistive material by applying local heat directly on the component substrate. For example, U.S. Pat. No. 4,703,557, given to John Nespor et al., proposes to pre-fire thick film resistor in a kiln, to provide an initial TCR adjustment. Then, the resistor is laser annealed to controllably adjust the TCR. The process requires scanning of the entire resistor surface by a laser beam and thereby the process is expensive (time inefficient). Another method is proposed by US Patent Application 20060279349 "Trimming temperature coefficients of electronic components and circuits". The essence of the method is to form both the resistor and the heater on a silicon substrate. Special circuitry activates the heater resulting in TCR adjustment of the resistor. However, this solution is not suitable for resistors dissipating power more than 1 milliwatt during normal use, because self-heating may change the previously adjusted TCR. Typical current sense resistors dissipate hundreds of milliwatts of power. Therefore, the described method is not suitable for current sensors.

d) Forming a four-terminal resistor by cutting slots in the terminals of the resistor. Reference is made to FIG. 3 (prior art), which is a perspective view of four-terminal resistor 20, such as described in U.S. Pat. No. 5,999,085, given to Joseph Szwarc. Resistor 20 includes metal terminals 22 and metal resistive element 24. Slots 25 divide each terminal 22 to current pad portion 26 and sense pad portion 28. The depth of slots 25 influences the TCR of four-terminal resistor 20 and is selected to optimize the thermal stability of resistor 20. The method is empirical and suitable for resistors having solid metal terminals. Wraparound film terminals in film resistors are typically deposited on ceramic substrate and the cutting through the terminals during the manufacturing process is questionable.

e) Using two resistive elements connected in parallel or two resistive elements connected in series, for example as described in U.S. Pat. No. 3,970,983, given to Isao Hayasaka, and in U.S. Pat. No. 6,097,276, given to Jan Van Den Broek at al. Reference is made to FIG. 4 (prior art), which is a perspective view of two-terminal resistor 30, having two resistive elements 34 electrically connected in parallel, disposed on substrate 36. Reference is also made to FIG. 5 (prior art), which is a perspective view of two-terminal resistor 40, having two resistive elements 44 electrically interconnected in series by conductive element 48 and disposed on substrate 46. One of resistive elements (34, 44) in each pair has a positive TCR, and the second resistive element has a negative TCR. Laser trimming of both resistive elements makes it possible to adjust both resistance and TCR of the compound resistor (30, 40). It is not possible to implement the method with resistive materials having only positive (only negative) TCR. Up-to-date, low resistance thick-film materials, based on noble metals, have only positive TCR.

There is therefore a need and it would be advantageous to be able to design four-terminal current sense resistors with a TCR adjustment procedure, applicable in a manufacturing process. It would be advantageous to be able to enable TCR adjustment while using resistive materials with only positive (or only negative) TCR.

SUMMARY OF THE INVENTION

According to the teachings of the present invention, there is provided a four-terminal current sensing resistor including four (4) elementary resistors forming a closed loop. The elementary resistors include:

a) a principal low-ohmic value resistor having a resistive element disposed between two terminals, wherein the measured electrical current is forced across the terminals of the principal resistor and thereby the terminals of the principal resistor serve as "Force" terminals;

b) a sensing resistor having a resistive element disposed between two terminals, wherein voltage is measured over the sensing resistor and thereby the terminals of the sensing resistor serve as "Sense" terminals; and c) two dividing resistors, wherein a first dividing resistor electrically connects a first terminal of the principal resistor with a first terminal of the sensing resistor, and the second dividing resistor electrically connects the second terminal of the principal resistor with the second terminal of the sensing resistor, thereby the dividing resistors and the sensing resistor form a voltage divider. The voltage measured on "Sense" terminals is proportional to the current forced across "Force" terminals.

In variations of the present invention, the two dividing resistors are combined into a single dividing resistor, whereas the dividing resistor electrically connects a first terminal of the principal resistor with a first terminal of the sensing resistor, and the second terminal of the principal resistor is directly connected to the second terminal of the sensing resistor, thereby the dividing resistor and the sensing resistor form a voltage divider.

An aspect of the present invention is to provide a four-terminal resistor wherein both resistance and TCR of the four-terminal resistor can be adjusted during the manufacturing process by adjustment of resistances of the elementary resistors. Typically, the elementary resistors that can be adjusted during the manufacturing process are selected from the group consisting of the principal resistor and the sensing resistor.

An aspect of the present invention is to provide a four-terminal resistor wherein the resistive materials from which all elementary resistors are made of, have the same sign of TCR (either positive or negative).

An aspect of the present invention is to provide a four-terminal resistor wherein the absolute values of the TCR of the resistive materials from which the dividing resistors are made of are higher than the absolute value of the TCR of the resistive material from which the sensing resistor is made of.

BRIEF DESCRIPTION OF THE DRAWINGS

The present invention will become fully understood from the detailed description given herein below and the accompanying drawings, which are given by way of illustration and example only and thus not limitative of the present invention, and wherein.

DESCRIPTION OF THE PREFERRED EMBODIMENTS

Figure 2:
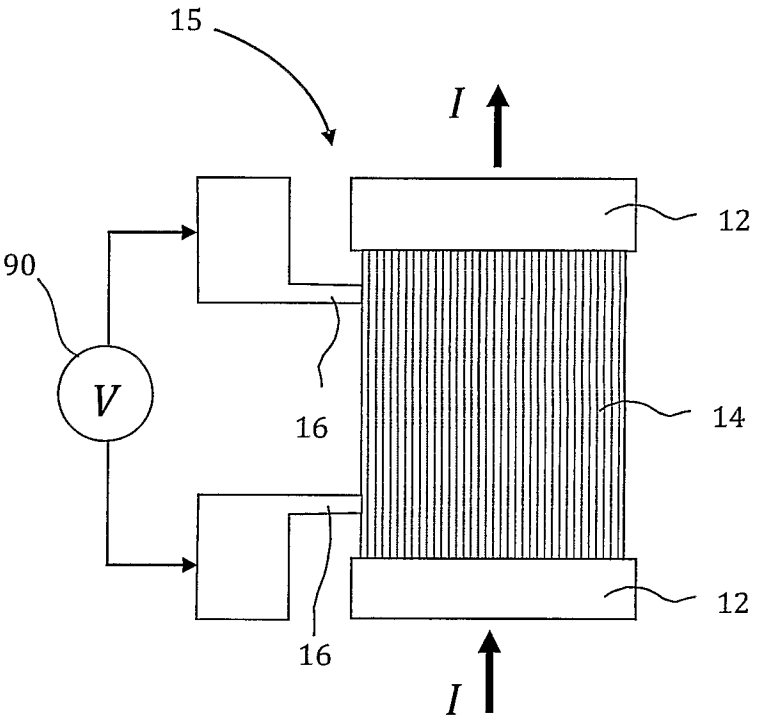
Fig 2 PRIOR ART
FIG. 2 (prior art) illustrates an example four-terminal resistor.
Figure 1:
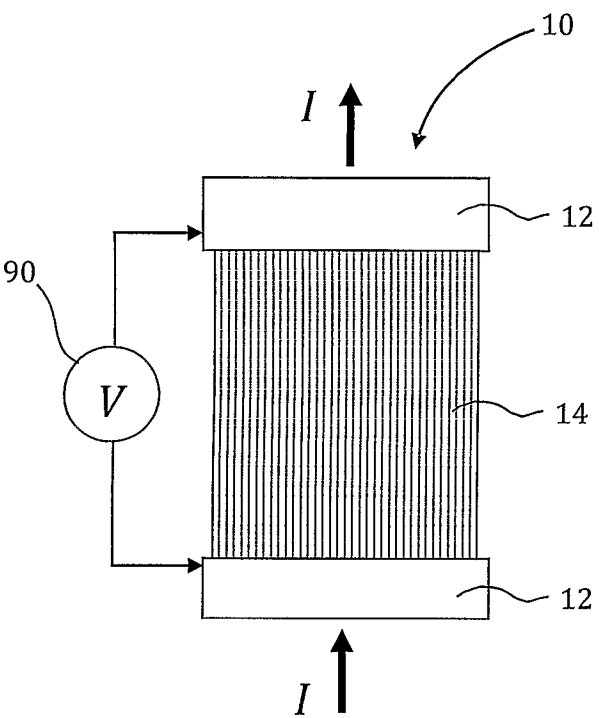
Fig 1 PRIOR ART
FIG. 1 (prior art) illustrates an example two-terminal resistor.
Figure 4:
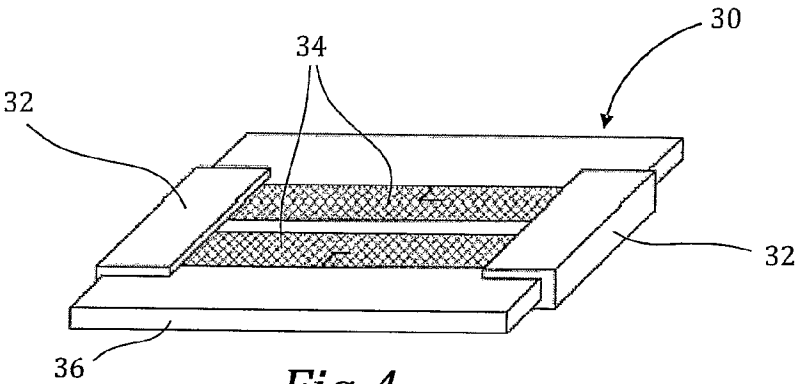
Fig 4 PRIOR ART
FIG. 4 (prior art) illustrates a precision resistor having two resistive elements, electrically connected in parallel, wherein one resistive element has a positive TCR and the second resistive element has a negative TCR.
Figure 5:
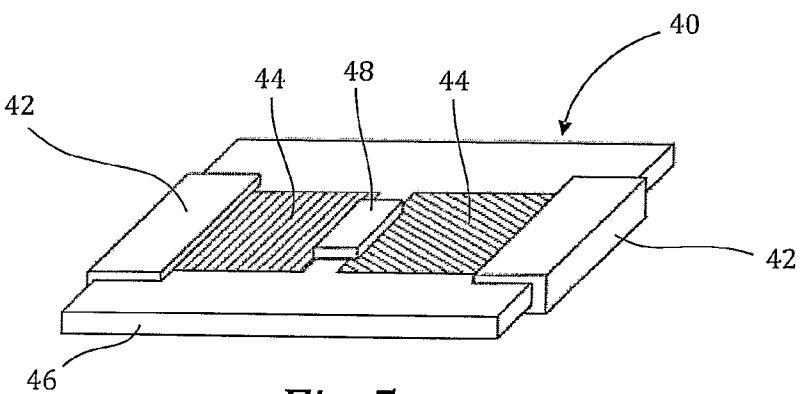
Fig 5 PRIOR ART
FIG. 5 (prior art) illustrates a precision resistor having two resistive elements, electrically connected in series, wherein one resistive element has a positive TCR and the second resistive element has a negative TCR.
Figure 3:
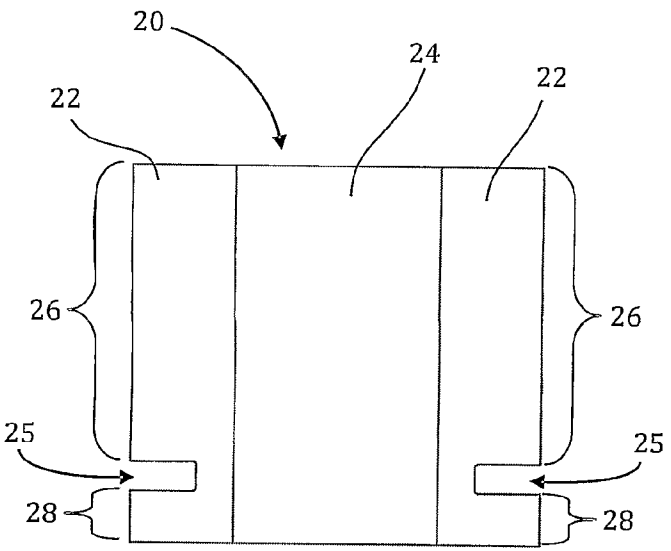
Fig 3 PRIOR ART
FIG. 3 (prior art) is a perspective view of precision metal resistor, having two slots in the resistor terminals for TCR adjustment.

Before explaining embodiments of the invention in detail, it is to be understood that the invention is not limited in its application to the details of construction and the arrangement of the components set forth in the host description or illustrated in the drawings.

Unless otherwise defined, all technical and scientific terms used herein have the same meaning as commonly understood by one of ordinary skill in the art to which the invention belongs. The methods and examples provided herein are illustrative only and not intended to be limiting.

A principle intention of the present invention includes providing a four-terminal resistor having a structure that enables TCR adjustment during the manufacturing process and thereby, the absolute value of the TCR of the four-terminal resistor is lower than the absolute values of the TCR of the resistive materials used to manufacture the four-terminal resistor. The used resistive materials may have either only positive or only negative TCR.

Figure 7:
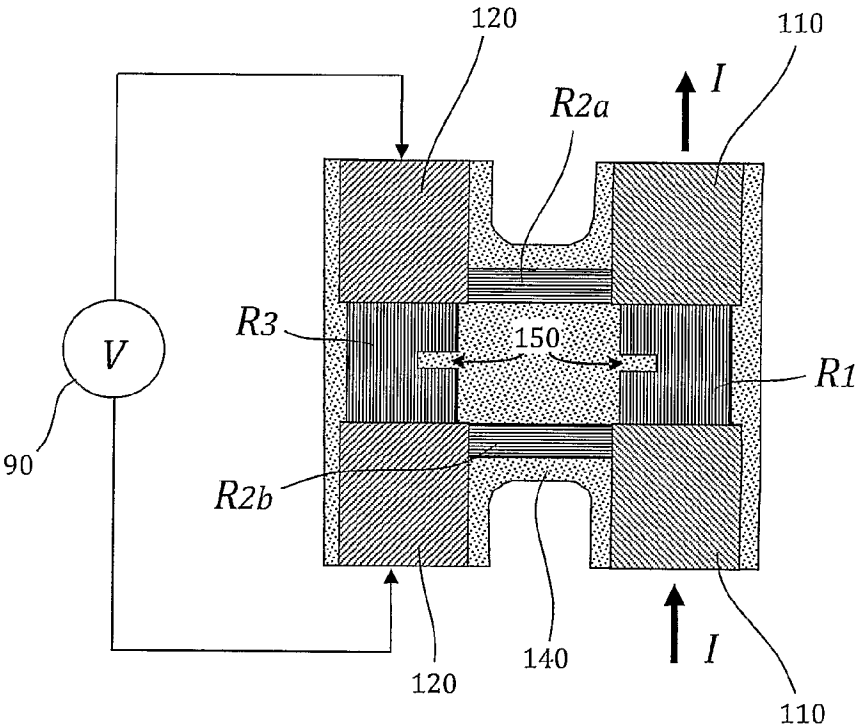
FIG. 7 illustrates a layout of four-terminal film resistor that embodies the electrical schematic shown in FIG. 6.
Figure 6:
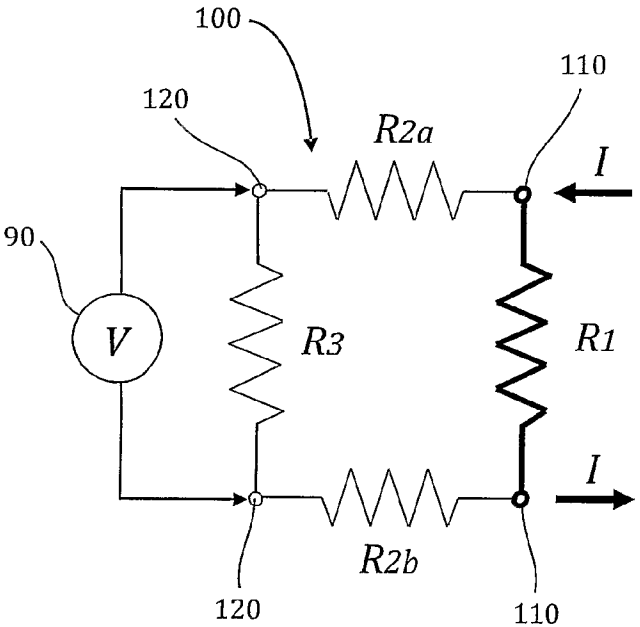
FIG. 6 is an electrical schematic illustration of a four-terminal resistor, according to the preferred embodiment of the present invention.

Reference is now made to FIG. 6, which is an electrical schematic illustration of four-terminal resistor 100, according to the preferred embodiment of the present invention. Reference is also made to FIG. 7 that illustrates a layout of four-terminal film resistor 100 that embodies electrical schematic shown in FIG. 6.

Four-terminal resistor 100 includes four (4) elementary resistors R1, R2*a*, R2*b* and R3, forming a closed loop. RI is the principal low-ohmic value resistor. Terminals 110 of resistor R1 serve as "Force" terminals, whereas the measured electrical current is forced across terminals 110 of resistor R1. Resistors R2*a*, R2*b* and R3 form a voltage divider connected in parallel to resistor R1. Terminals 120 of resistor R3 serve as "Sense" (voltage measurement) terminals of four-terminal resistor 100, whereas voltage V, measured by voltmeter 90, is proportional to current I and is sensed across terminals 120. In the preferred embodiment, four-terminal resistor 100 includes substrate 140, on which elementary resistors R1, R2*a*, R2*b* and R3 are disposed.

The required resistance value of four-terminal resistor 100 may be attained by a proper selection of preliminary resistance values of elementary resistors R1, R2*a*, R2*b* and R3, and a further adjustment of one or more of resistors R1, R2*a*, R2*b* and R3.

Figure 9:
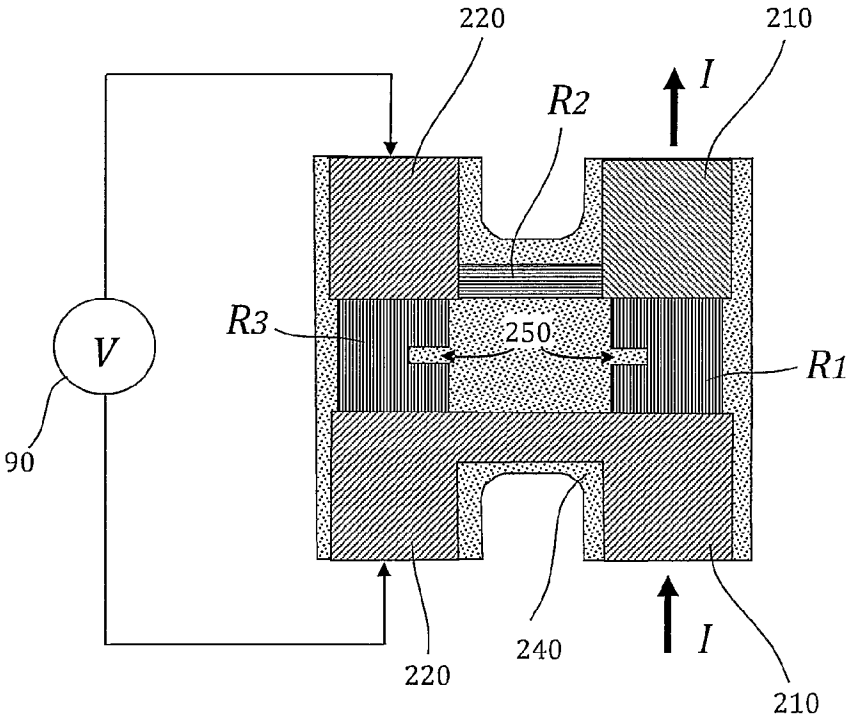
FIG. 9 illustrates a layout of four-terminal film resistor that embodies the electrical schematic shown in FIG. 8.
Figure 8:
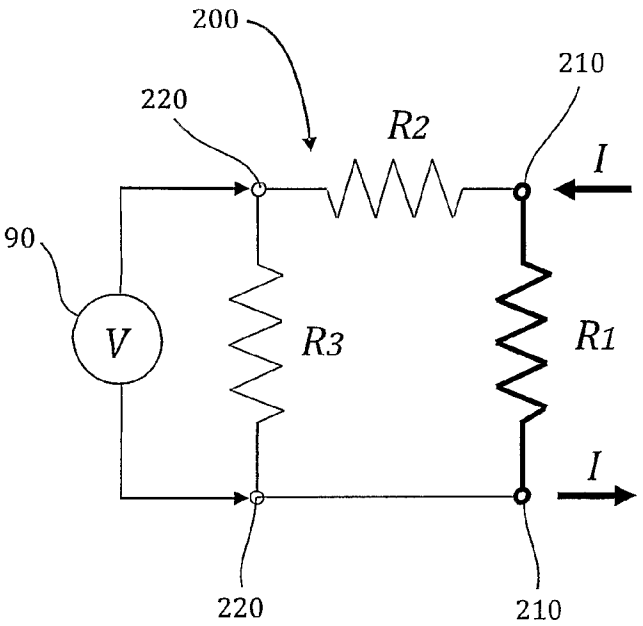
FIG. 8 is an electrical schematic illustration of a four-terminal resistor, according to variations of the present invention.

Reference is also now made to FIG. 8, which is an electrical schematic illustration of four-terminal resistor 200, according to variations of the present invention. Reference is also made to FIG. 9 which illustrates a layout of four-terminal film resistor 200 that embodies electrical schematic shown in FIG. 8.

Four-terminal resistor 200 includes three (3) elementary resistors R1, R2 and R3, forming a closed loop, whereas compared with four-terminal resistor 100, elementary resistors R2*a* and R2*b* are combined in four-terminal resistor 200 into single elementary resistor R2. R1 is the principal low-ohmic value resistor. Terminals 210 of resistor R1 serve as "Force" terminals, whereas the measured electrical current is forced across terminals 210 of resistor R1. Resistors R2 and R3 form a voltage divider connected in parallel to resistor R1. Terminals 220 of resistor R3 serve as "Sense" (voltage measurement) terminals of four-terminal resistor 200, whereas voltage V, measured by voltmeter 90, is proportional to current I and is sensed across terminals 220. Four-terminal resistor 200 includes substrate 240, on which elementary resistors R1, R2 and R3 are disposed.

The required resistance value of four-terminal resistor 200 may be attained by a proper selection of preliminary resistance values of elementary resistors R1, R2 and R3, and a further adjustment of one or more of resistors R1, R2 and R3.

It should be noted that the layout of four-terminal resistors 100 includes less dissimilar patterns than the layout of four-terminal resistors 200 and thereby, it may be advantageous in product design and manufacturing.

An aspect of the present invention is to provide a method to adjust the TCR of four-terminal resistors 100 and 200, including obtaining four-terminal resistor (100,200) whereas the absolute value of the TCR of the manufactured four-terminal resistor (100,200) is lower than the absolute values of the TCR of the resistive materials used to manufacture the resistor (100,200).

Typically, resistors R3 and R1 can be adjusted by a laser to pre-determined resistance values to obtain the required resistance value of the compound four-terminal resistor (100, 200) and to minimize the absolute value of the TCR of the four-terminal resistor (100, 200). Slits 150 and 250 exemplify trimming cuts made to elementary resistors R3 and R1 of four-terminal resistors 100 and 200, respectively.

One method to minimize the absolute value of the TCR of four-terminal resistors 100 and 200 includes selection of resistive materials with the proper TCR for the elementary resistors (R1, R2 and R3) and further adjustment of resistances of the elementary resistors. It should be noted that all of the elementary resistors (R1, R2 and R3) of the four-terminal resistor (100, 200) may have the same sign of TCR. Resistive materials for resistor R2 and resistors R3 are selected such that the absolute value of the TCR of resistor R2 is higher than the absolute value of the TCR of resistor R3.

The proposed structure of four-terminal resistor (100, 200), proper selection of resistive materials, and adjustment of resistances of the elementary resistors enables TCR minimization in four-terminal resistor (100, 200) during the manufacturing process.

Let us introduce designations $\tilde{R}_2(t)$ for resistance of R2 and $\tilde{R}_3(t)$ for resistance of R3 as functions of temperature rise t. The value t=0 corresponds to a selected reference temperature (for example, ambient temperature of 25° C.).

To exemplify the TCR adjustment method of the present invention, let us consider the simplest case where $\tilde{R}_2(t)$ and $\tilde{R}_3(t)$ are linear functions:

$$\tilde{R}_2(t)=R_2(1+\alpha_2 t)$$

$$\tilde{R}_3(t)=R_3(1+\alpha_3 t)$$

wherein all of the elementary resistors (R1, R2 and R3) have the same sign (for instance positive) of TCR.

The above assumptions state that:

$$\alpha_2>\alpha_3>0. \tag{3}$$

To clarify the TCR adjustment method, let us monitor what happens to the R3/R2 resistance ratio when the temperature of resistors R2 and R3 increases. For that purpose let us compute the derivative of $\tilde{R}_3(t)/\tilde{R}_2(t)$ with respect to t:

$$\frac{d}{dt}\left(\frac{\tilde{R}_3(t)}{\tilde{R}_2(t)}\right) = \frac{d}{dt}\left[\frac{R_3(1+\alpha_3 t)}{R_2(1+\alpha_2 t)}\right] = \frac{R_3}{R_2}\cdot\frac{\alpha_3-\alpha_2}{(1+\alpha_2 t)^2} \quad (4)$$

It follows from equations (3) and (4) that the derivative is negative, which means that the value of R3/R2 ratio has a negative temperature coefficient (R3/R2 resistance ratio decreases when temperature t increases), regardless of the fact that all elementary resistors (R1, R2 and R3) of the four-terminal resistor (100, 200) have a positive TCR. Thereby, the TCR adjustment method of the present invention enables to compensate the positive TCR of principal resistor R1 and minimize the TCR of four-terminal resistor (100, 200). It follows from (4) that the value of R3/R2 ratio will have a negative temperature coefficient regardless the sign of $\alpha_3$. Therefore, only resistors R1 and R2 must have the same (positive, in the aforementioned example) sign of TCR.

An increase in the ambient temperature results in resistance increase (positive TCR) in all elementary resistors (R1, R2 and R3). Two opposing changes of the "Sense" voltage occur at the same time, as a result of the following cause-and-effect relations:

a) Resistance increase in all elementary resistors (R1, R2 and R3) results in a voltage increase over resistor R1 and in a voltage increase over divider R2-R3. Thereby, the "Sense" voltage increases over resistor R3.

b) The decrease of resistance ratio R3/R2, results in a "Sense" voltage decrease over resistor R3.

Thereby, the decrease of resistance ratio R3/R2 compensates for the "Sense" voltage increase caused by resistance increase in all elementary resistors (R1, R2 and R3), as a result of the increase in the ambient temperature.

Similarly, a decrease in the ambient temperature results in "Sense" voltage decrease caused by R1, R2 and R3 resistance decrease (positive TCR), which is compensated by an increase of resistance ratio R3/R2.

The compensating effect associated with voltage divider R2, R3 enables to minimize the temperature influence on the "Sense" voltage and thereby to minimize the TCR of the four-terminal resistor (100, 200).

To summarize, the following are the target conditions:

a) the two aforementioned cause-and-effect relations of temperature on "Sense" voltage, result in the effects cancellation, at the predesigned reference temperature; and b) Kelvin resistance of four-terminal resistor (100, 200) (ratio of "Sense" voltage to current forced across "Force" terminals) is equal to the required resistance value.

The aforementioned two target conditions may be transformed into a system of two equations that enable the calculation of two of the three resistance values of the elementary resistors (R1, R2 and R3). The third resistance value and the three respective TCR values of resistors R1, R2 and R3 have to be given values.

The two of three elementary resistors can be adjusted to calculated resistance values using, for example, laser trimming equipment.

Both calculation of unknown resistance values in resistor network, to meet particular conditions and resistance value adjustment in a resistor network, are well-known procedures for skilled person in the industry.

The invention being thus described in terms of embodiments and examples, it will be obvious that the same may be varied in many ways. Such variations are not to be regarded as a departure from the spirit and scope of the invention, and all such modifications as would be obvious to one skilled in the art are intended to be included within the scope of the claims.

What is claimed is:

1. A four-terminal resistor, comprising:

a low-ohmic value principal resistor having a resistive element disposed between two force terminals, the force terminals being configured to carry an electrical current that is forced through the principal resistor;

a sensing resistor having a resistive element disposed between two sense terminals, the sense terminals being configured for measurement of a sense voltage measured over the sensing resistor;

a first dividing resistor having a resistive element disposed between a first force terminal and a first sense terminal; and a second dividing resistor having a resistive element disposed between a second force terminal and a second sense terminal, wherein the principal, sensing and dividing resistors are configured in a closed loop;

wherein an absolute value of the TCR of the resistive materials from which the dividing resistors are made is higher than an absolute value of the TCR of the resistive material from which the sensing resistor is made;

wherein the sense voltage is proportional to the electrical current forced through the principal resistor.

2. The four-terminal resistor of claim 1, wherein the first and second dividing resistors are combined into a single dividing resistor, wherein the single dividing resistor, electrically connects the first terminal of the principal resistor with the first terminal of the sensing resistor, and the second terminal of the principal resistor is directly connected to the second terminal of the sensing resistor, the single dividing resistor and the sensing resistor form a voltage divider.

3. The four-terminal resistor of claim 1, wherein the TCR of the four-terminal resistor is adjusted changing the resistance of at least one of the principal, sensing or dividing resistors.

4. The four-terminal resistor of claim 3, having a TCR absolute value that is lower than the absolute values of the TCR of the resistive materials of the principal, sensing and dividing resistors.

5. The four-terminal resistor of claim 1, wherein the resistive materials from which the principal, sensing and dividing resistors are made have the same sign of TCR.

6. A method of making a four-terminal resistor, the method comprising:

providing a low-ohmic value principal resistor having a resistive element disposed between two force terminals, the force terminals being configured to carry an electrical current that is forced through the principal resistor;

providing a sensing resistor having a resistive element disposed between two sense terminals, the sense terminals being configured for measurement of a sense voltage measured over the sensing resistor;

providing a first dividing resistor having a resistive element disposed between a first force terminal and a first sense terminal; and providing a second dividing resistor having a resistive element disposed between a second force terminal and a second sense terminal, wherein the principal, sensing and dividing resistors are configured in a closed loop;

wherein an absolute value of the TCR of the resistive materials from which the dividing resistors are made is higher than an absolute value of the TCR of the resistive material from which the sensing resistor is made; and wherein the sense voltage is proportional to the electrical current forced across the force terminals.

7. The method of 6, wherein the first and second dividing resistors are combined into a single dividing resistor, wherein the single dividing resistor electrically connects the first terminal of the principal resistor with the first terminal of the sensing resistor, and the second terminal of the principal resistor is directly connected to the second terminal of the sensing resistor, the single dividing resistor and the sensing resistor form a voltage divider.

8. The method of 6, wherein the TCR of the four-terminal resistor is adjusted changing the resistance of at least one of the principal, sensing or dividing resistors.

9. The method of 6, wherein the four-terminal resistor has a TCR absolute value that is lower than the absolute values of the TCR of the resistive materials of the principal, sensing and dividing resistors.

10. The method of 6, wherein the resistive materials from which the principal, sensing and dividing resistors are made have the same sign of TCR.

11. A four-terminal resistor, comprising:

a low-ohmic value principal resistor having a resistive element disposed between two force terminals, the force terminals being configured to carry an electrical current that is forced through the principal resistor;

a sensing resistor having a resistive element disposed between two sense terminals, the sense terminals being configured for measurement of a sense voltage measured over the sensing resistor; and a single dividing resistor, wherein the single dividing resistor electrically connects a first force terminal of the principal resistor with a first terminal of the sensing resistor, and a second terminal of the principal resistor is directly connected to a second terminal of the sensing resistor, the single dividing resistor and the sensing resistor forming a voltage divider;

wherein the sense voltage is proportional to the electrical current forced through the principal resistor.

12. A method of making a four-terminal resistor, the method comprising:

providing a low-ohmic value principal resistor having a resistive element disposed between two force terminals, the force terminals being configured to carry an electrical current that is forced through the principal resistor;

providing a sensing resistor having a resistive element disposed between two sense terminals, the sense terminals being configured for measurement of a sense voltage measured over the sensing resistor; and providing a single dividing resistor, wherein the single dividing resistor electrically connects a first terminal of the principal resistor with a first terminal of the sensing resistor, and a second terminal of the principal resistor is directly connected to a second terminal of the sensing resistor, the single dividing resistor and the sensing resistor forming a voltage divider;

wherein the sense voltage is proportional to the electrical current forced across the force terminals.

* * * * *